US006111493A

United States Patent [19]

Onishi et al.

[11] Patent Number: 6,111,493

[45] **Date of Patent: *Aug. 29, 2000**

[54] VARIABLE RESISTOR

[75] Inventors: Katsuhiro Onishi, Sabae; Kiminori Yamauchi, Fukui; Hideaki Tsukada, Sabae; Yukinori Ueda; Fumitoshi Masuda, both of Fukui-ken, all of Japan

[73] Assignee: Murata Manufacturing Co., Ltd., Nagaokakyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/974,223

[22] Filed: Nov. 19, 1997

[30] Foreign Application Priority Data

Nov. 20, 1996 [JP] Japan ..... 8-309812

[51] Int. Cl.[7] ..... H01C 10/32

[52] U.S. Cl. ..... 338/162; 338/164; 338/171; 338/152; 338/166

[58] Field of Search ..... 338/162–164, 338/171, 150, 152, 166, 170

[56] References Cited

U.S. PATENT DOCUMENTS

| | | | |
|---|---|---|---|
| 3,676,824 | 7/1972 | Mulqueen et al. | 338/162 |
| 3,683,308 | 8/1972 | Hamill | 338/162 |
| 4,998,088 | 3/1991 | Masura | 338/162 |
| 5,053,742 | 10/1991 | Masura | 338/162 |
| 5,201,410 | 4/1993 | Takano et al. | 200/531 |
| 5,305,110 | 4/1994 | Taki et al. | 348/836 |
| 5,414,403 | 5/1995 | Greuter et al. . | |
| 5,790,012 | 8/1998 | Nakatsu et al. | 338/152 |

FOREIGN PATENT DOCUMENTS

| | | |
|---|---|---|
| 92-5213 U | 3/1992 | Rep. of Korea . |

*Primary Examiner*—Lincoln Donovan
*Assistant Examiner*—Richard K. Lee
*Attorney, Agent, or Firm*—Burns, Doane, Swecker & Mathis, LLP

[57] ABSTRACT

A variable resistor comprises a case, slide contactors, a rotor, a metal cover and lead terminals. Arms which are respectively provided at central portions of the slide contactors protrude from a bottom surface of a recess portion of the case and are each shaped like a comb. The arms are respectively contacted, at contact portions A, B and C, by electrodes and resistor of the rotor. Lead terminals are each circular in cross section and are respectively connected, at end surfaces of their lead wires, to the slide contactors. This makes it possible to obtain a variable resistor which is easy to manufacture, low in cost and excellent in reliability.

24 Claims, 10 Drawing Sheets

VARIABLE RESISTOR

The present specification is based on Japanese Patent Document No. 8-309812, which is incorporated herein in its entirety by reference.

BACKGROUND OF THE INVENTION

1. Field of the Invention

The present invention relates to a variable resistor and, more particularly, to a residue-proof (e.g., dust-proof) variable resistor equipped with a case.

2. Description of the Related Art

FIG. 21 shows a conventional variable resistor. This variable resistor 80 comprises an alumina substrate 84 having a horseshoe resistor 81 on its surface. The resistor also includes a collector electrode thin film 83 and electrode thin films 82, respectively connected to both end portions of the horseshoe resistor 81. A case 85 is provided for accommodating the alumina substrate 84 therein. Three lead terminals 86 (one of which is shown in FIG. 21) pass through the alumina substrate 84 and are respectively soldered to the electrode thin films 82 and 83. A rotor 87 is provided in the case 85 and a slider 89 is disposed on a rear surface of the rotor 87. A sealing O-ring 90 is disposed on the rotor 87 and a resin 91 is provided for sealing an opening in the rear surface of the case 85.

Furthermore, a plurality of the variable resistors 80, forming complete products, can be wrapped together to form a taping set, such that, for each resistor 80, a lead terminal 86 projecting out from the rear surface of the case 85 is pinched between a mount and an adhesive tape. Alternatively, the resistor 80 can be wrapped as a single unit, such that the lead terminal 86 is cut to a prescribed length. When mounting the variable resistor 80 in the above-described taping set onto a printed circuit board or the like, a variable resistor 80 is separated from the mount by an automatic inserter and is inserted into the printed circuit board or the like. Thereafter, the lead terminal 86 is cut and clinched and then is preliminarily fixed in place. Next, the variable resistor 80 is soldered to the printed circuit board.

However, there are a number of problems associated with the conventional variable resistor 80 described above, as enumerated below.

(1) Since the lead terminal 86 is a press-worked product, the sectional configuration thereof is rectangular. Therefore, during cutting and clinching which occurs during the mounting performed by the automatic inserter, the cutting blade initially abuts against an angular portion of the lead terminal 86. At other times, the cutting blade abuts against a planar portion of the lead terminal 86. Thus, the load applied to the cutting blade differs with the result that a cutting error is likely to occur. This, in turn, can reduce the service life of the cutting blade.

(2) Since the connection between the lead terminal 86 and the electrode thin films 82 and 83 is made by soldering, it is necessary to perform flux cleaning processing, which is a relatively expensive operation. This procedure therefore adds to the cost of the product.

(3) The use of resin 91 to perform sealing entails a complex filling operation and hardening operation, which also is a factor which increases the cost of the product.

(4) In a case where the variable resistors 80 are wrapped into a taping set, press working of the lead terminal 86 requires the use of a material having a width which is approximately twice as large as the length of the lead terminal 86. As a result, the pressing die becomes large in size which adds to the cost of the process and product produced thereby. Also, the rate (efficiency) at which the material is used becomes low. Therefore, the cost of the lead terminal increases. There also arises the inconvenience that, for example, it becomes necessary to use a different width of material between the taping set and the single unit product.

SUMMARY OF THE INVENTION

The present invention has an exemplary objective to provide a variable resistor which is easy to manufacture, low in cost and excellent in reliability, which does not suffer from the above-mentioned problems.

To attain the above object, according to the present invention, there is provided a variable resistor comprising:

(a) a case having a recess portion, (b) at least two slide contactors exposed in a bottom surface of the recess portion of the case, (c) a rotor having a resistor and electrode provided on its surface and rotatably accommodated in the recess portion of the case, (d) a cover disposed on an end opening of the recess portion of the case, and (e) lead terminals substantially circular in cross section and respectively connected to the slide contactors, (f) whereby the slide contactors are respectively slidable on the resistor and electrode.

In the above-described variable resistor, at least one of the slide contactors can be connected to a lead terminal via a "land" portion exposed on a surface of the case. Alternatively, at least one of the slide contactors may have an extended portion which is led out from the case and the lead terminal can be connected to this extended portion. Alternatively, at least one of the slide contactors can be insert-molded in the case such that the contactor is firmly connected to the lead terminal. Also, the rotor can be comprised of, for example, a resin-integrated structure or ceramic-integrated structure and can be composed of a substrate having the resistor and electrode provided on the rotor's surface and a resinous main body in combination.

Further, the cover has mounting claw portions. Forward end portions of the mounting claw portions are folded back, and slits and engagement portions are provided in and on the mounting claw portions, whereby the mounting claw portions are inserted by force into holes provided in the case, and the cover is mounted on the case. Also, preferably, the cover can have an adjusting opening at its central part and at least one of bending and burring is performed on an edge portion of this adjusting opening toward the side of the rotor.

Since the lead terminal is substantially circular in cross section, at the time of a cutting and clinching operation during the mounting performed by the automatic inserter, the cutting blade at all times abuts against a smooth curved surface of the lead terminal. Therefore, no variation occurs in the load applied to the cutting blade and this eliminates the possibility of a cutting error being made. Also, since clinching, i.e., bending of the lead terminal, is stabilized, the reliability on the mounting with respect to the printed circuit board or the like becomes high. Furthermore, since at least one of the slide contactors has a lead terminal connection "land", the lead terminal is reliably connected to this lead terminal connection land by resistance welding or ultrasonic welding.

Also, since at least one of the slide contactors has an extended portion which is led out from the case and the lead terminal is connected to this extended portion, the position of the lead terminal can be easily changed. In another embodiment, at least one of the slide contactors is connected to a lead terminal and then this combination is insert-molded in the case. This sequence of operations reduces the potentially damaging effects caused by the heat used for connecting the contactor with the lead terminal. In addition, a portion of a connection between the lead terminal and the slide contactor is reinforced by the case, so that the strength of the lead terminal as well as the sealability of the case is enhanced.

Also, the unique cover construction of the present invention, including mounting claw portions makes it unnecessary to perform the conventional sealing operations based on the use of resin, so that the number of the assembling steps can be reduced. Further, by performing the bending or burring of the edge portion of the adjusting opening provided at the central part of the cover toward the rotor side, the insertability of the driver at the adjusting time is enhanced and the strength of the cover itself is increased. Accordingly, the deformation of the top surface of the cover after the mounting of the cover is prevented, and the contact reliability of the contact between the resistor or electrode and the slide contactors is enhanced.

BRIEF DESCRIPTION OF THE DRAWINGS

The foregoing and other, objects, features and advantages of the present invention will be more readily understood upon reading the following detailed description in conjunction with the drawings in which.

DETAILED DESCRIPTION OF THE PREFERRED EMBODIMENTS

Embodiments of a variable resistor according to the present invention will now be explained with reference to the appended drawings. In each embodiment, the same parts and portions are denoted by like reference symbols.

1. First Embodiment, FIGS. 1 to 13

Figure 1:
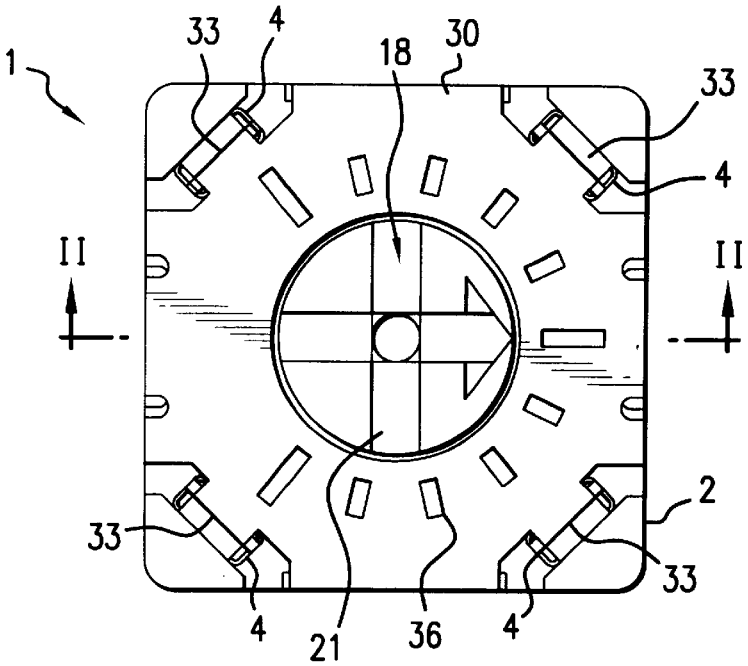
FIG. 1 is a plan view illustrating a first exemplary embodiment of a variable resistor according to the present invention.
Figure 2:
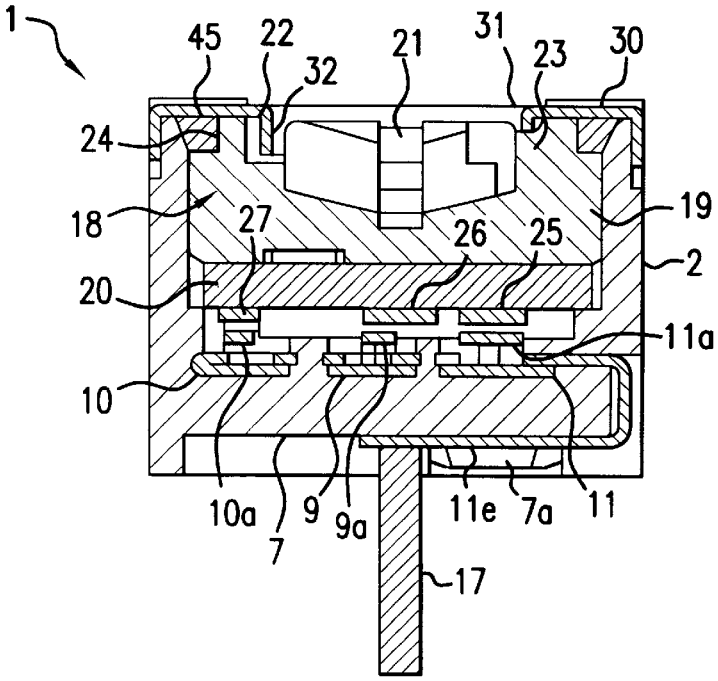
FIG. 2 is a sectional view taken along a line II—II of the variable resistor illustrated in FIG. 1.
Figure 3:
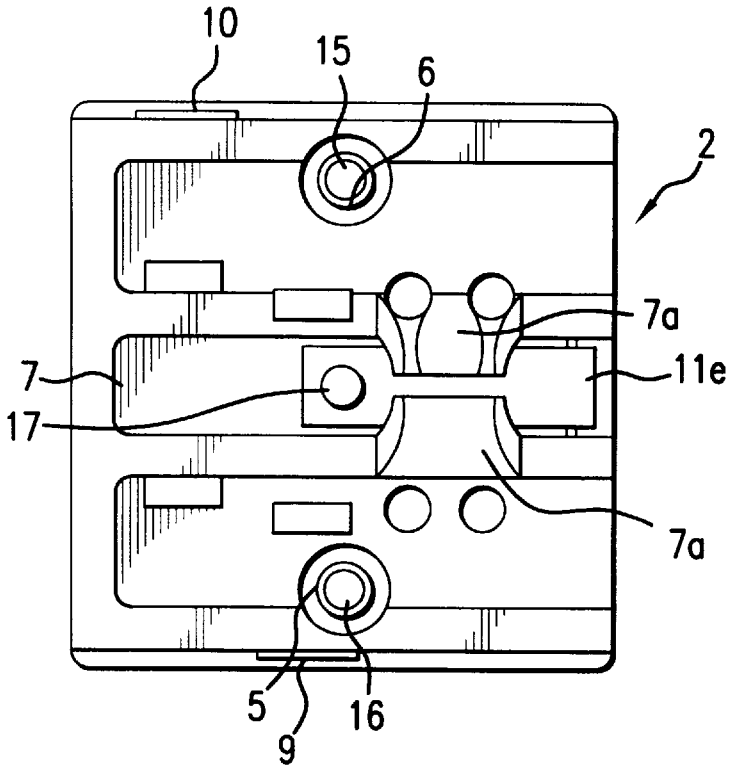
FIG. 3 is a bottom surface view illustrating the variable resistor illustrated in FIG. 1.

As illustrated in FIGS. 1 to 3, a variable resistor comprises a case 2, slide contactors, rotor, metal cover, and lead terminals, which will be individually discussed below.

Figure 4:
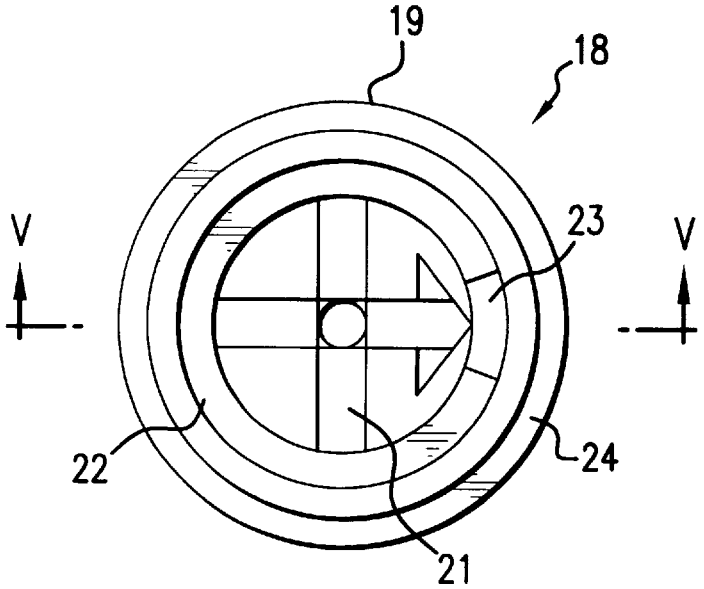
FIG. 4 is a plan view illustrating a rotor used in the variable resistor illustrated in FIG. 1.
Figure 5:
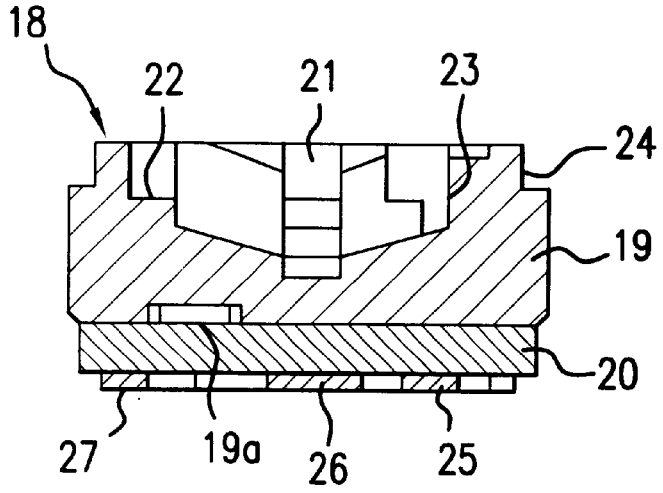
FIG. 5 is a sectional view taken along a line V—V of the rotor illustrated in FIG. 4.
Figure 6:
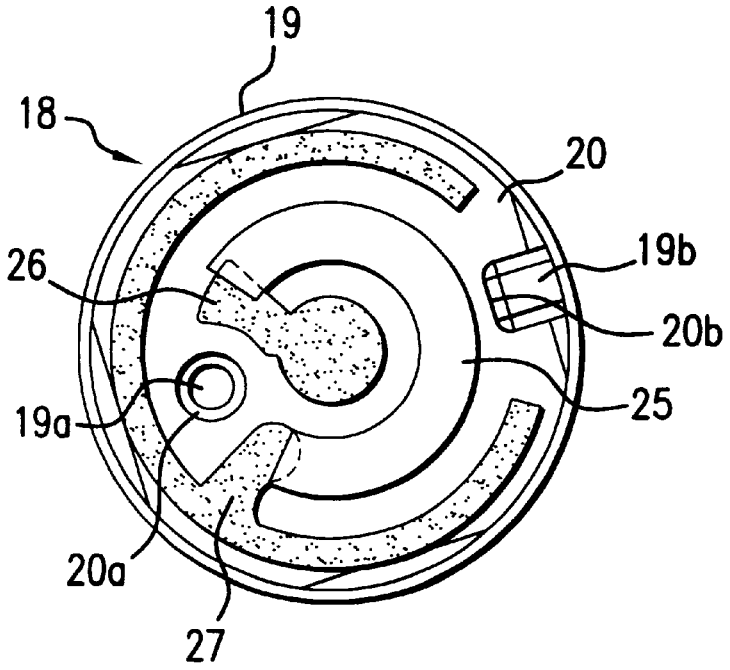
FIG. 6 is a bottom surface view illustrating the rotor illustrated in FIG. 4.

As illustrated in FIGS. 4 to 6, the rotor 18 of the variable resistor is substantially shaped as a circular column and is composed of a main body 19 and a substrate 20 bonded to the underside of this main body 19. At the central part of the upper surface of the main body 19 there is provided a crossed groove 21 for use with a driver. Around the crossed groove there is provided an escape groove 22 substantially shaped as a circular arc. Further, a stopper 23 is provided at a prescribed position on this escape groove 22. A notch 24 is provided in the outer-peripheral edge portion of the upper surface of the main body 19. On the underside of the main body 19 there are provided projections 19*a* and 19*b*.

In the substrate 20 there is provided a hole 20*a* and a notch 20*b*. The hole and notch are made to positionally coincide with the projections 19*a* and 19*b*, respectively. The projections 19*a* and 19*b* respectively fit into the hole 20*a* and notch 20*b*. As a result, the displacement between the main body 19 and the substrate 20 due to the rotation thereof is prevented. Further, a horseshoe resistor 25 is formed on the underside of the substrate 20 using, for example, screen printing, a transfer technique, or the like. The end portions of the resistor 25 are electrically connected to an inner-peripheral electrode 26 and an outer-peripheral electrode 27, respectively. The inner-peripheral electrode 26 and outer-peripheral electrode 27 are formed concentrically with the horseshoe resistor 25. The inner-peripheral electrode 26 has a circular portion at the central part of the substrate 20. The outer-peripheral electrode 27 has a circular arc portion at the outer-peripheral part of the substrate 20.

The main body 19 and the substrate 20 are fabricated using, for example, a ceramic material such as alumina or using a heat-resisting resin such as polyphenylene sulfide, or the like. The resistor 25 is fabricated, for example, using a cermet resistor or carbon resistor. If, for example, inexpensive polyphenylene sulfide resin is used as the material for the main body 19 and substrate 20, and an inexpensive carbon resistor is used for the resistor 25, it is possible to reduce the manufacturing cost of the variable resistor.

As illustrated in FIGS. 7 to 10, a case 2 has a recess portion 3. The recess portion 3 is circularly shaped in cross section in conformity with the configuration of the rotor 18 and is thereby so designed that the rotor 18 accommodated in the recess portion 3 can be smoothly rotated within the recess portion 3. A hole is provided at each of the four corners of the upper surface of the case 2. The case 2 is made of, for example, polyamide system nylon having a high resistance to heat such as 46 nylon, thermoplastic resin such as polyphenylene sulfide, polybutylene terephthalate or liquid crystal polymer, or thermosetting resin such as epoxy or diallyl phthalate. If especially using a polyphenylene sulfide resin, the resistance to moisture is also enhanced.

Figure 7:
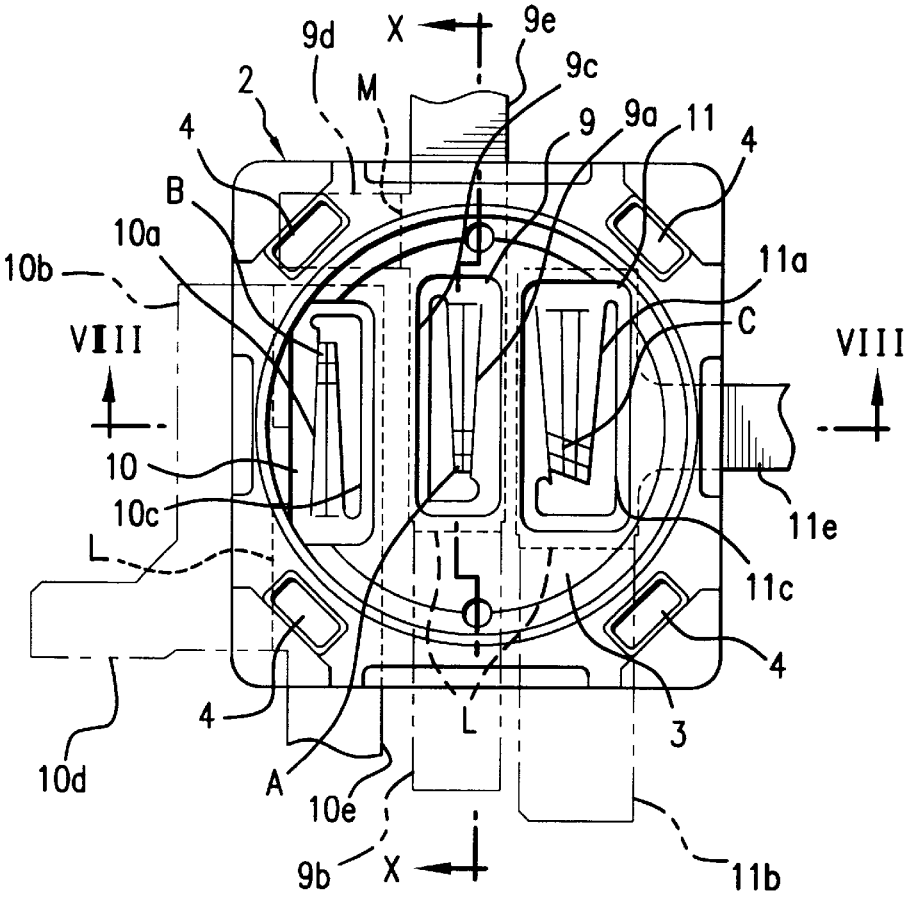
FIG. 7 is a plan view illustrating a case used in the variable resistor illustrated in FIG. 1.
Figure 8:
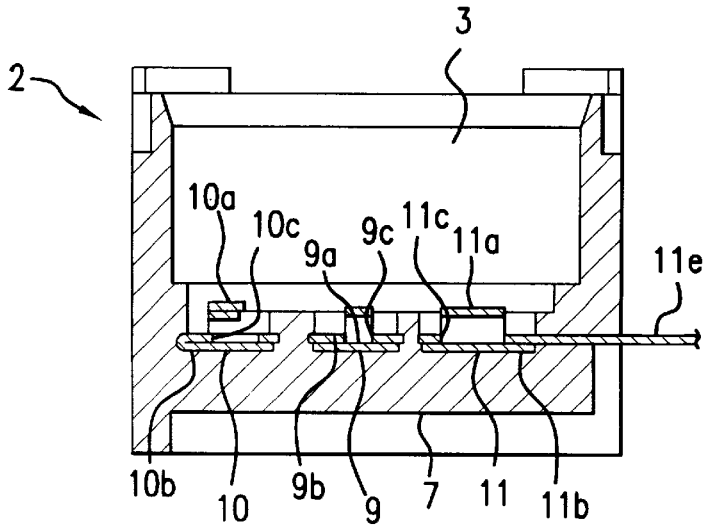
FIG. 8 is a sectional view taken along a line VIII—VIII of the case illustrated in FIG. 7.
Figure 9:
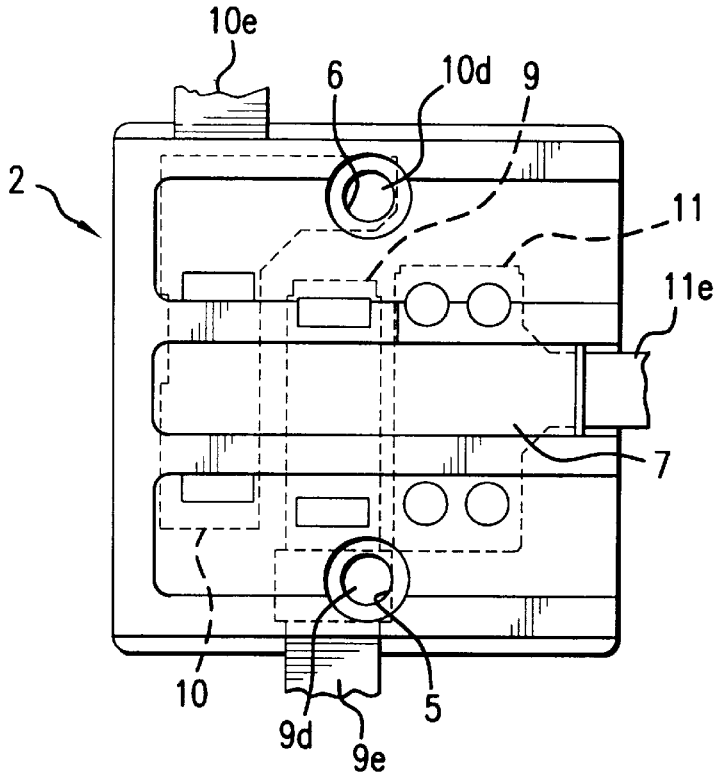
FIG. 9 is a bottom surface view illustrating the case illustrated in FIG. 7.
Figure 10:
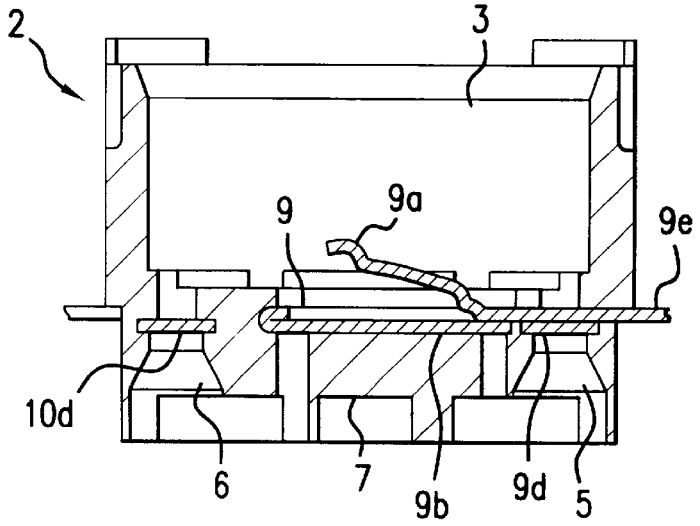
FIG. 10 is a sectional view taken along a line X—X of the case illustrated in FIG. 7.

Slide contactors 9, 10 and 11 are, for example, insert molded in a bottom portion of the case 2 and are partly exposed from the bottom surface of the recess portion 3 of the case 2. The slide contactors 9 to 11 are structured such that their bottom portions 9*b* to 11*b* indicated in two-dot chain lines in FIG. 7 are each folded back at a folding-back line L and each folded-back bottom portion is disposed over the corresponding remaining bottom portion, the two bottom portions being thus doubled. By virtue of these bottom portions 9*b* to 11*b*, the underside of the slide contactors 9 to 11 are lidded to ensure a seal for the interior of the case 2. This, in conjunction with the outer-peripheral portions of the slide contactors 9 to 11, prevents molten resin from flowing onto the surfaces of arms 9*a* to 11*a* when resin-molding the case 2. This prevents the molten resin from attaching onto the arms, which, in turn, simplifies the resin molding process.

The respective arms 9*a*, 10*a* and 11*a* provided at the central portions of the slide contactors 9, 10 and 11 protrude from the bottom surface of the recess portion 3. Each of these arms is shaped like a comb. The arms 9*a* to 11*a* provide a contact, at their contact portions A, B and C, with the circular portion of the electrode 26, the circular arc portion of the electrode 27 and the resistor 25 of the rotor 18, respectively. The outer-peripheral portions of the slide contactors 9 to 11 are embedded in the case 2. At the central portions thereof, where the arms 9*a* to 11*a* are provided, there are provided substantially L-shaped (or substantially horizontally U-shaped) notches 9*c* to 11*c*. By providing these notches 9*c* to 11*c*, the formation of the comb-shaped arms 9*a* to 11*a* is facilitated and the spring-like property of the arms 9*a* to 11*a* is improved.

Further, the slide contactor 9 is arranged such that a "land" 9*d* for connection of a lead terminal, indicated in a two-dot chain line in FIG. 7, is folded back at a folding-back line M. The lead terminal connection land 9*d* is exposed in an opening 5 for the lead terminal which is provided in the underside of the case 2 (see FIGS. 9 and 10). Similarly, the slide contactor 10 is arranged such that a land 10*d* for connection of a lead terminal, indicated in a two-dot chain line in FIG. 7, is exposed in an opening 6 therefor which is provided in the underside of the case 2.

A led-out or extended portion lie of the slide contactor 11 is extended from the side surface of the case 2. This portion 11*e* is bent along the case 2 and, as illustrated in FIG. 2, is directed by a guide groove 7 provided in the underside of the case 2 to follow a prescribed track. Thereby, a forward end portion thereof is disposed at a central part of the underside of the case 2. At this time, as illustrated in FIG. 3, both side wall portions 7*a* at prescribed positions with respect to the guide groove 7 are caulked. As a result of this, the extended portion 11*e* can be firmly fixed to the underside of the case 2 and prevented from becoming detached. Furthermore, extended portions 9*e* and 10*e* of the slide contactors 9 and 10, respectively, which are extended from the side surface of the case 2, are cut away in a succeeding step. The slide contactors 9 to 11 are each made of, for example, a copper alloy such as white metal having a spring-like property or a metal plate such as stainless steel.

As illustrated in FIGS. 2 and 3, lead terminals 15, 16 and 17 are each circular in cross section. The lead terminals 15 and 16 are bonded, at the end surfaces of their lead wires, to the lead terminal connection lands 9*d* and 10*d* which are exposed in the lead terminal openings 5 and 6 provided in the underside of the case 2, by soldering, resistance welding, ultrasonic welding, or other technique. By the same method, the lead terminal 17 is bonded, at the end surface of its lead wire, to the extended portion 11*e* disposed on the underside of the case 2. In the special case where resistance welding or ultrasonic welding is used as the bonding method, the flux cleaning performed when soldering is used becomes unnecessary. This makes it possible to reduce the manufacturing cost and also to reduce the use of substances which must be handled and disposed of in an environmentally safe manner.

Figure 11:
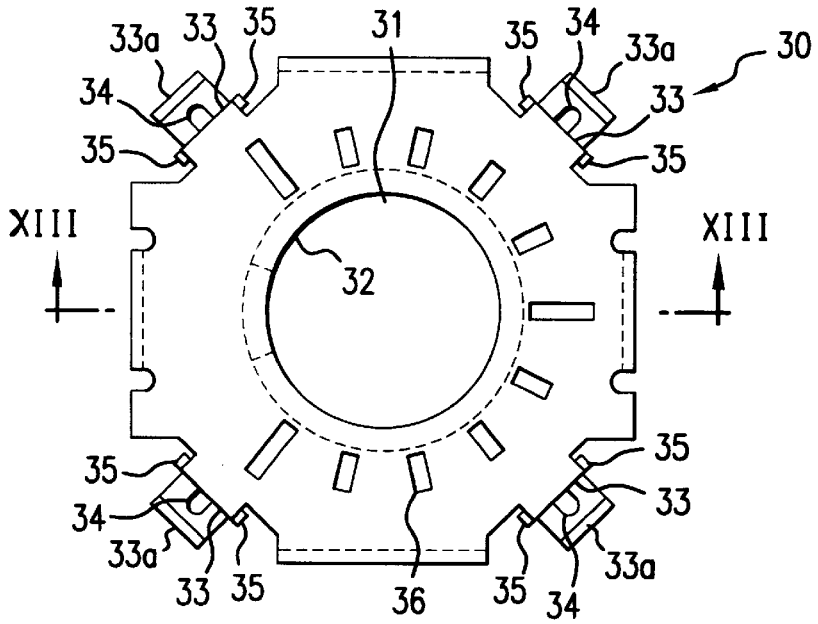
FIG. 11 is a plan view illustrating a metal cover used in the variable resistor illustrated in FIG. 1.
Figure 12:
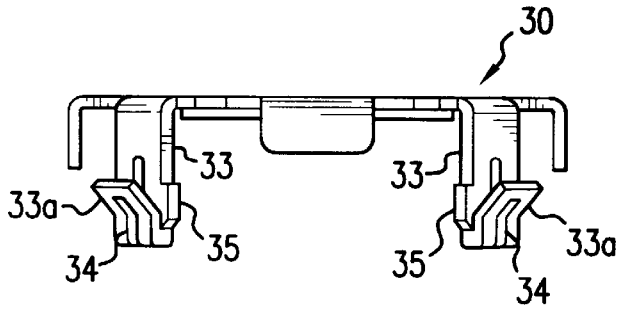
FIG. 12 is a side view illustrating the metal cover illustrated in FIG. 11.
Figure 13:
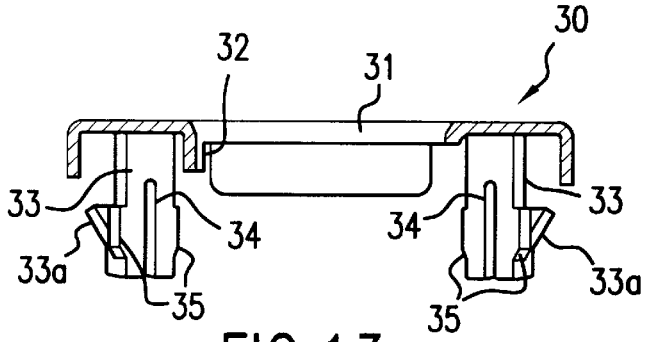
FIG. 13 is a sectional view taken along a line XIII—XIII of the metal cover illustrated in FIG. 11.

As illustrated in FIGS. 11 to 13, the metal cover 30 is provided with an opening 31 for use in conjunction with a driver at its central part and has graduations 36 around this opening 31. Also, a tongue-shaped stopper receiver 32 is provided in contact with this opening 31. The edge portion of the for-use-of-driver opening 31 is bent and raised toward the rotor 18 by bending or burring. As a result of this, the insertability of the driver when adjustment is made is enhanced, the strength of the cover 30 itself is increased, the deformation of the top surface of the cover 30 after the mounting thereof is prevented, and the contact reliability of the contact between the resistor 25 or electrodes 26, 27 and the arms 9*a* to 11*a* of the slide contactors 9 to 11 is enhanced.

Mounting claw portions 33 are provided at four comers of the metal cover 30. Forward end portions 33*a* of the mounting claw portions 33 are folded back. Projections 35 are provided on both sides of each mounting claw portion 33 as viewed in the widthwise direction thereof. Thus, due to these features, the metal cover 30 is not easily removed from the case 2. Further, a slit 34 is provided at a central part of the mounting claw portion 33 as viewed in the widthwise direction thereof, with the result that forced insertion into the case 2 is facilitated and simultaneously the retention force can be increased. The metal cover 30 is made of, for example, metal material such as stainless steel.

An O-ring 45 for providing a seal illustrated in FIG. 2 is made of, for example, silicone rubber. By using a silicone rubber having a hardness of 60° to 70°, it is possible to reduce the amount of the backlash of the rotor 18 which occurs when rotation adjustment is made by a driver.

The above-described constituent parts are assembled in accordance with the following procedure. That is, the rotor 18 is inserted in the recess portion 3 of the case 2 in such a way that the resistor 25 and the electrodes 26 and 27 thereof respectively contact with the contact portions C, A and B. Also, the thickness of the rotor 18 is so set that the upper surface thereof is slightly higher than the upper surface of the recess portion 3 of the case 2. This is for the purpose of making the contact between the rotor and the metal cover 30 reliable and thereby making the backlash of the rotor 18 small. Next, the O-ring 45 is inserted in the gap between the outer-peripheral edge portion 24 of the rotor 18 and the case 2. Thereafter, the metal cover 30 is inserted over the case 2. Subsequently, the mounting claw portions 33 are inserted by force into the holes 4 of the case 2. Thereby, the metal cover 30 is firmly mounted on the case 2 in a state where the rotor 18 is confined in the recess portion 3. The case 2 is then sealed.

Accordingly, the conventional sealing operation performed using resin can be omitted, and the number of the assembling steps can be reduced. In addition, the backlash of the rotor 18 can be reduced and the displacements of the contact positions between the resistor 25 and the electrodes 26, 27 and their corresponding contact portions A to C are suppressed, such that the setting of the resistance values is stabilized.

In a variable resistor 1 which has been assembled in the manner described above, by applying a forward end portion of the driver to the for-use-of-driver crossed groove 21 of the rotor 18 to thereby rotate the rotor 18, the contact portion C is brought into sliding contact with the resistor 25, the contact portion A is brought into sliding contact with the inner-peripheral electrode 26, and the contact portion B is brought into sliding contact with the outer-peripheral electrode 27 to cause variation of the resistance value between the terminals 15 and 17 and the resistance value between the terminals 16 and 17. At this time, the stopper receiver 32 provided on the metal cover 30 is disposed in the escape groove 22 provided in the rotor 18. This stopper receiver 32, in conjunction with the stopper 23 provided in the rotor 18, regulates the rotation angle of the rotor 18.

In the variable resistor 1 having the above-described construction, since the lead terminals 15 to 17 are each circular in cross section, at the time of a cutting and clinching operation during the mounting thereof performed by an automatic inserter, the cutting blade at all times abuts against a smooth curved surface of the lead terminals 15 to 17. As a result, no variation occurs in the load applied to the cutting blade, and as such, there is little likelihood of a cutting error being made. Also, clinching after cutting can be stably performed because of the absence of directionality in the terminals. The above-described properties of the variable resistor enhance the reliability of mounting the resistor on a printed circuit board or the like. Further, the service life of the cutting blade is prolonged and this contributes to reducing the cost of the manufacturing process and the resultant product. Also, since the connection of the lead terminals 15 to 17 is made with respect to the slide contactors 9 to 11, unlike the conventional connection thereof made with respect to the electrode thin films formed on the alumina substrate, that connection becomes a highly reliable connection which has, for example, excellent electrical and mechanical characteristics. Further, since the slide contactors 9 and 10 have the lead terminal connection lands 9*d* and 10*d*, the lead terminals 15 and 16 are respectively securely and reliably connected to the lead terminal connection lands 10*d* and 9*d* by resistance welding, ultrasonic welding or the like, with the result that the reliability of the connection between the lead terminals 15 and 16 and the slide contactors 9 and 10 is further enhanced. Also, since the slide contactor 11 has the extended portion 11*e* which is led out from the side surface of the case 2, it is possible to arbitrarily change the position at which the lead terminal 17 is connected to the extended portion lie, with the result that the pitch dimension between each two of the lead terminals 15, 16 and 17 can be easily made to adapt to various specifications.

Further, after each of the lead terminals 15 to 17 is made having an arbitrary length by suitably cutting wire material thereof to a required dimension, the lead terminals 15 to 17 can be connected to the slide contactors 9 to 11. Therefore, it is possible to cope with various demands for the length of the lead terminals at a low cost. Especially, when a plurality of the variable resistors 1 are wrapped into a taping set, wire material can be used for the lead terminals by suitably cutting the wire material to a required length. Thus, the wire material is not wasted. As a result, the rate at which the material is used is efficient and this reduces manufacturing cost.

2. Second Embodiment, FIGS. 14 to 20

A second embodiment is the same as the variable resistor of the first embodiment except for the various features described below.

Figure 14:
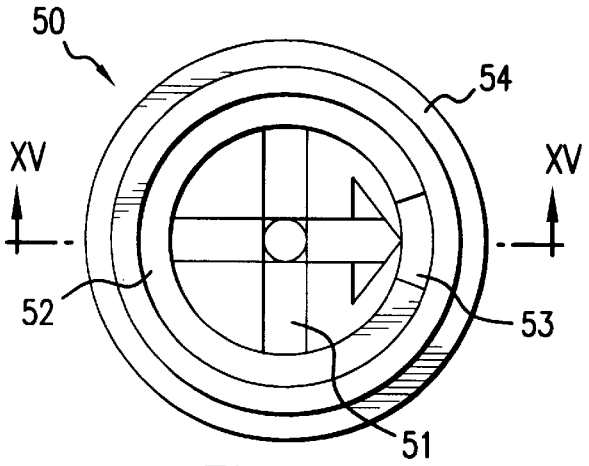
FIG. 14 is a plan view illustrating a rotor used in a second exemplary embodiment of the variable resistor according to the present invention.
Figure 15:
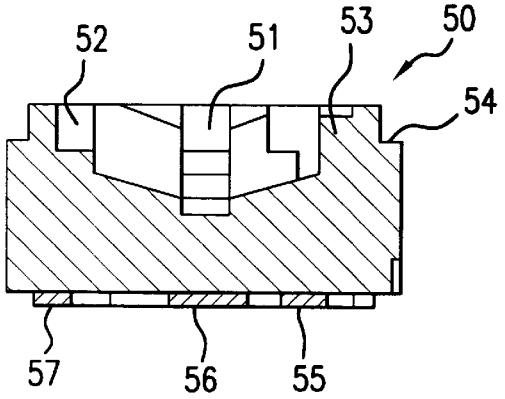
FIG. 15 is a sectional view taken along a line XV—XV of the rotor illustrated in FIG. 14.
Figure 16:
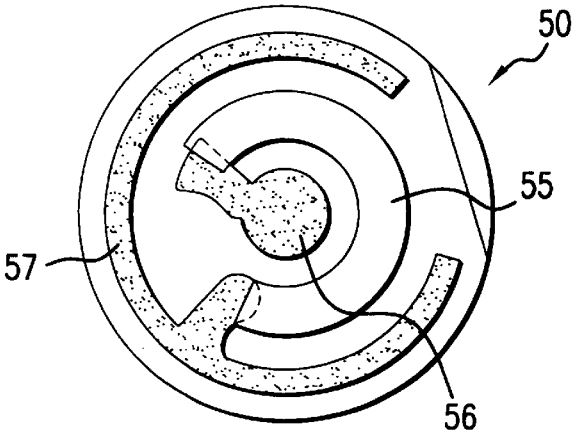
FIG. 16 is a bottom surface view illustrating the rotor illustrated in FIG. 14.
Figure 17:
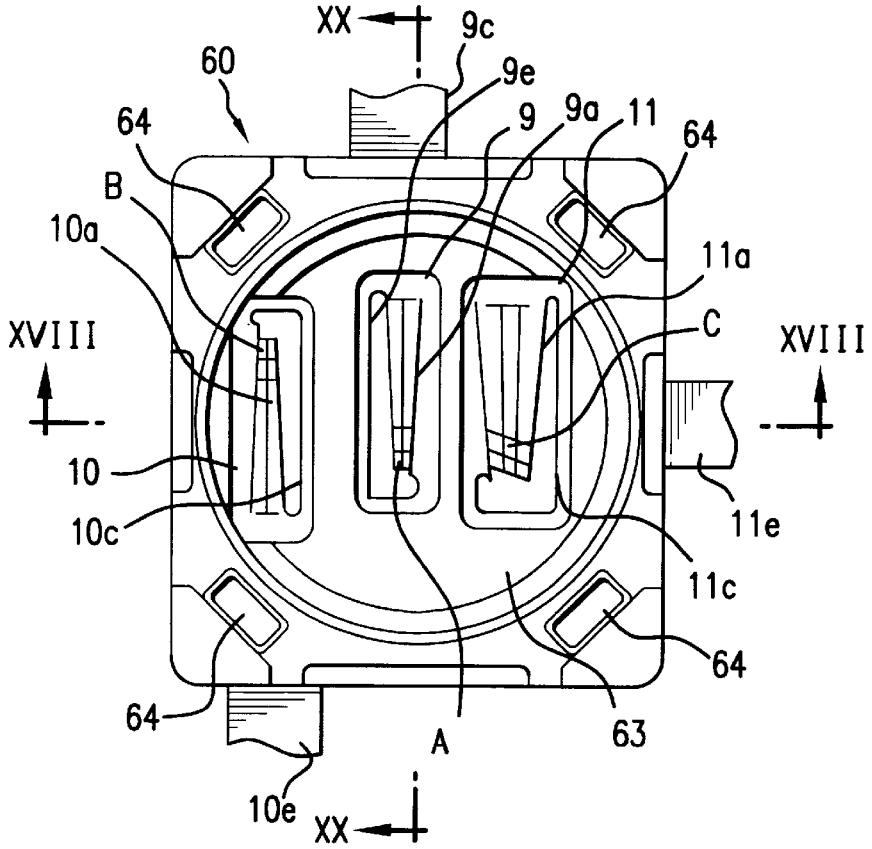
FIG. 17 is a plan view illustrating a case used in the variable resistor of the second embodiment.

As illustrated in FIGS. 14 to 16, a rotor 50 is substantially shaped as a circular column and is made up of an integrated structure made of, for example, resin. At a central part of the upper surface of the rotor 50 there is provided a crossed groove 51 for use in conjunction with a driver. Around the crossed groove 51 there is provided an escape groove 52 substantially shaped like a circular arc. Further, a stopper 53 is provided at a prescribed position in this escape groove 52. A notch 54 is provided in the outer-peripheral edge portion of the upper surface of the rotor 50. On the underside of the rotor 50 there are concentrically formed a horseshoe resistor 55, inner-peripheral electrode 56 and outer-peripheral electrode 57.

As illustrated in FIGS. 17 to 20, a case 60 has a recess portion 63. The recess portion 63 is circularly shaped in cross section in conformity with the shape of the rotor 50 and is thereby so designed that the rotor 50 can be inserted in the recess portion 63 and smoothly rotated therein. A hole 64 is provided at each of four corners of the upper surface of the case 60. The slide contactors 9, 10 and 11 are insert-molded in the bottom portion of the case 60 and are partly exposed in the bottom surface of the recess portion 63 of the case 60. The respective arms 9*a*, 10*a* and 11*a* provided at the central portions of the slide contactors 9, 10 and 11 protrude from the bottom surface of the recess portion 63. Each of these arms is shaped like a comb. The arms 9*a* to 11*a* contact, at their contact portions A, B and C, with the electrode 56, the electrode 57 and the resistor 55 of the rotor 50, respectively.

Figure 18:
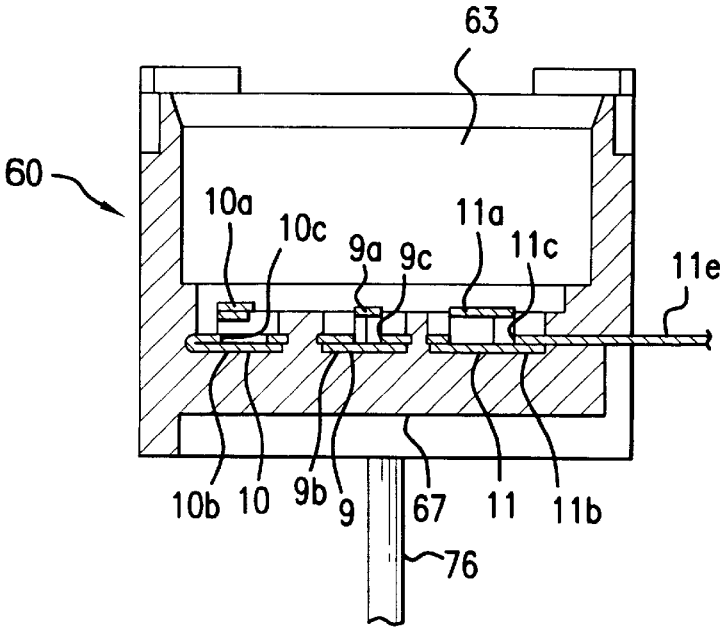
FIG. 18 is a sectional view taken along a line XVIII—XVIII of the case illustrated in FIG. 17.
Figure 19:
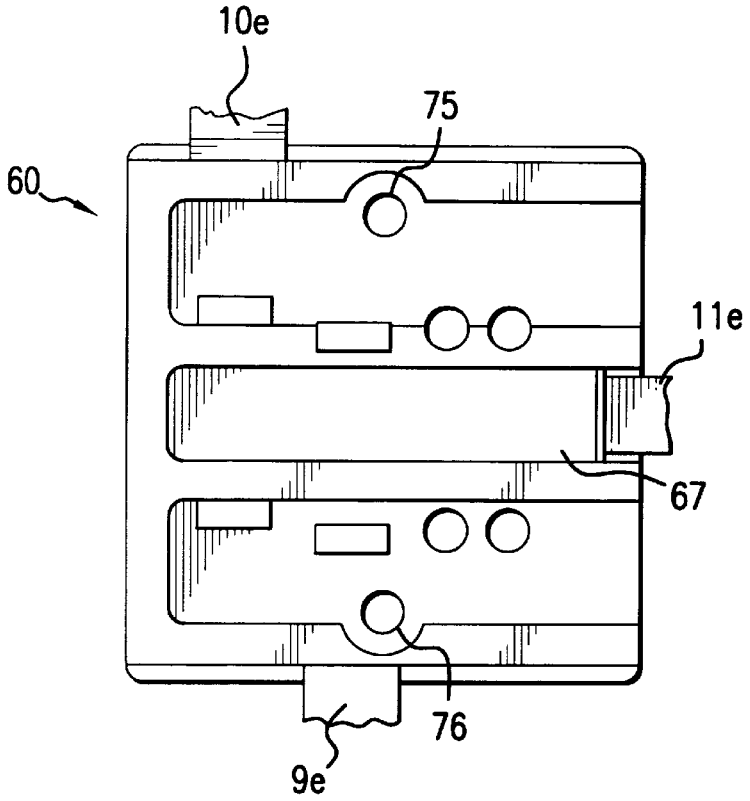
FIG. 19 is a bottom surface view illustrating the case illustrated in FIG. 17.
Figure 20:
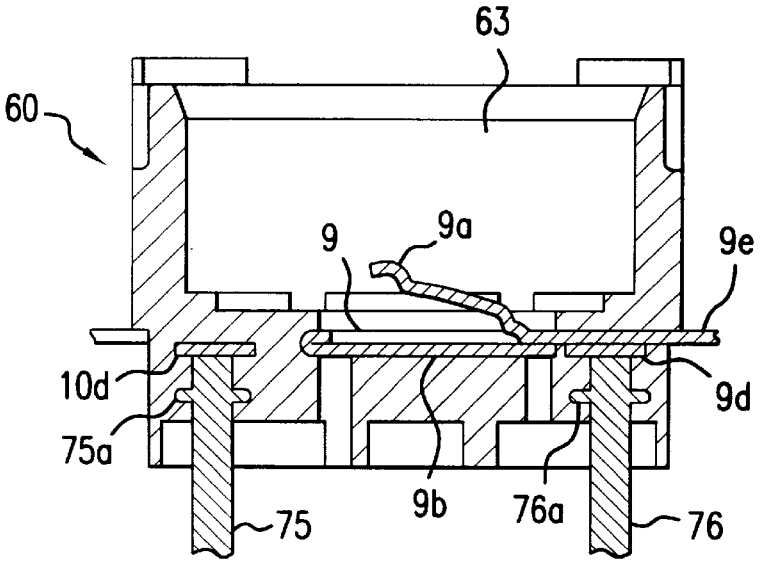
FIG. 20 is a sectional view taken along a line XX—XX of the case illustrated in FIG. 17.
Figure 21:
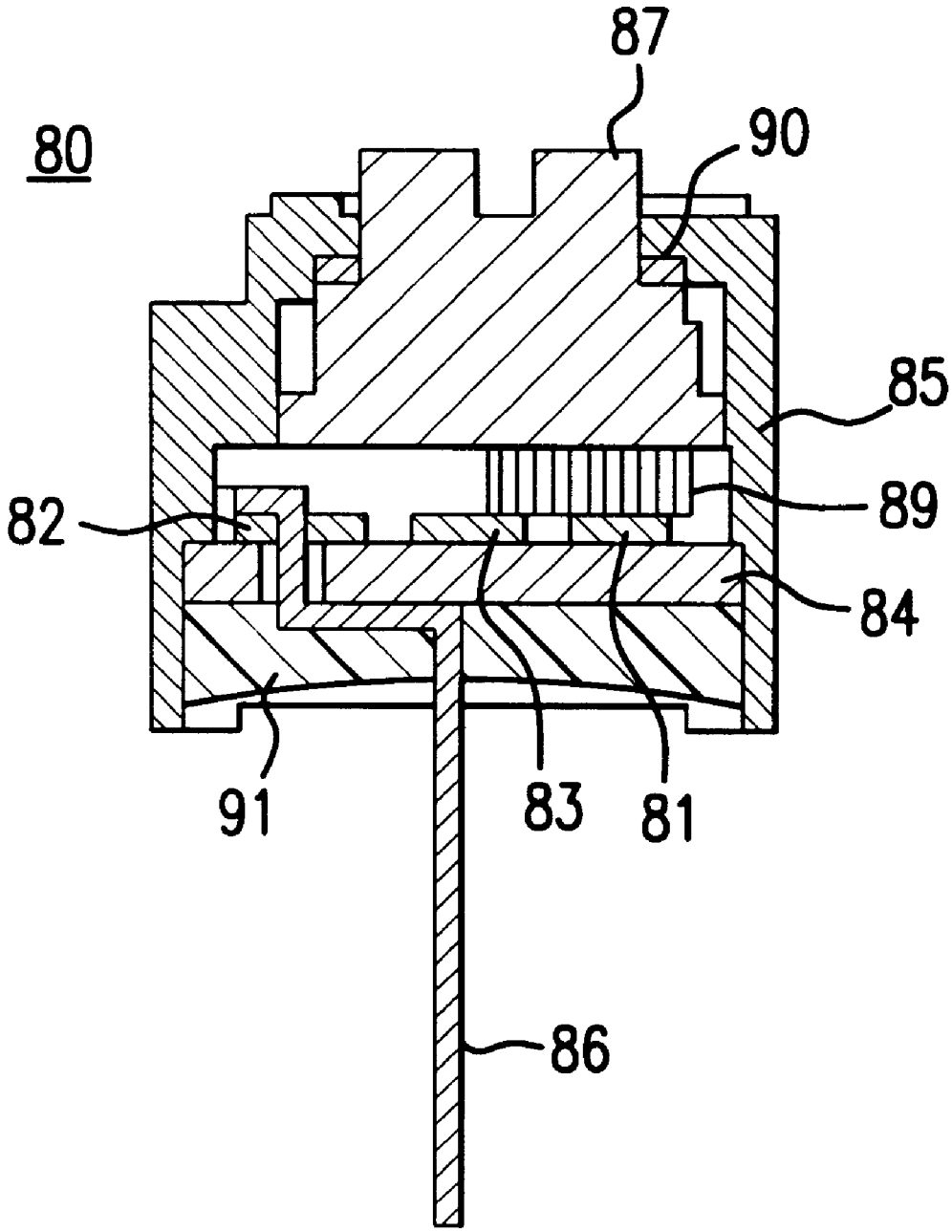
FIG.21 PRIOR ART
FIG. 21 is a sectional view illustrating a conventional variable resistor.

As illustrated in FIGS. 18 to 20, lead terminals 75 and 76 are circular in cross section and are respectively provided with terminal-retention flange-like projections 75*a* and 76*a*, respectively, near their head ends. These two lead terminals 75 and 76 are bonded, at end surfaces of their lead wires, to the lead terminal connection lands 9*d* and 10*d* of the slide contactors 9 and 10 by resistance welding, ultrasonic welding, or the like before the case 60 is resin-molded. Accordingly, when insert-molding is performed with respect to the case 60, the case 60 is obtained having integrated therewith the slide contactors 9 to 11 and lead terminals 75 and 76.

A led-out or extended portion lie of the slide contactor 11 which is extended from the side surface of the case 60 is bent along the case 60 and is led while being directed by a guide groove 67 provided in the underside of the case 60 along a prescribed path. Thereby, a forward end portion thereof is disposed at a central part of the underside of the case 60. The lead terminal circular in cross section is bonded, at the end surface of its lead wire, to this extended portion 11*e* by resistance welding, ultrasonic welding or the like. On the other hand, extended portions 9*e* and 10*e* of the slide contactors 9 and 10 which extend from the side surface of the case 60 are cut away in a succeeding step.

The variable resistor equipped with the above-structured parts has a function and effect similar to the first embodiment. Also, the connecting operation of the lead terminals 75 and 76 and the slide contactors 9 and 10 is performed before the case 60 is resin-molded. Therefore, the resistance welding or ultrasonic welding does not affect the quality of the resin, since the resin is added after the welding. Thus, a product having good quality is obtained. Also, since the connection between the lead terminals 75, 76 and slide contactors 9, 10 comprises a configuration which is reinforced by the case 60, the bonding strength of the lead terminals 75, 76 as well as the sealability of the case 60 is enhanced. Further, the flange-like projections 75*a* and 76*a* are provided on the end portions of the lead terminals 75 and 76 embedded in the case 60, which further enhances the bonding strength of the lead terminals 75 and 76. As a result, the load applied to the lead terminals 75 and 76 is not transferred to the connection point between the lead terminals 75 and 76 and the slide contactors 9 and 10. This has the result of further improving the reliability of the connection between the lead terminals and the slide contactors.

Various modification of the above-described two embodiments are possible. For example, in each of the above-described embodiments, the slide contactor 9 can be sliding contacted by the outer-peripheral electrode 27, 57, and the slide contactor 10 can be sliding contacted by the inner-peripheral electrode 26, 56 by interchanging the position at which the slide contactor 9 is disposed and the position at which the slide contactor 10 is disposed. Also, the outer-peripheral electrode 27, 57 or inner-peripheral electrode 26, 56 can be electrically connected to the end portion of only either one of the resistors 25 and 55.

As apparent from the foregoing description, according to the present invention, since a lead terminal which is circular in cross section is used, at the time of cutting and clinching during the mounting performed by the automatic inserter, the cutting blade at all times abuts against a smooth curved surface of the lead terminal. Therefore, no variation occurs in the load applied to the cutting blade and this eliminates the possibility of a cutting error being made. Also, since clinching after cutting is a reliable and stable sequence of operations, the reliability of the mounting on the printed circuit board or the like becomes high. Further, the service life of the cutting blade is prolonged and, as such, the cost can be reduced. Also, since a lead terminal is connected to a slide contactor, which can comprise a metal plate, a connection having excellent electrical and mechanical characteristics is obtained.

Also, the cover has mounting claw portions. Forward end portions of the mounting claw portions are folded back, and slits and engagement portions are provided in and on the mounting claw portions. The mounting claw portions are inserted by force into the holes provided in the case and the cover is thereby firmly mounted on the case to thereby seal the case. Therefore, it is possible to omit the conventional sealing operation based on the use of resin and reduce the number of the assembling steps. Further, the edge portion of the adjusting opening is bent toward the rotor by bending, burring or the like. As a result of this, the insertability of the driver when adjustment is made is enhanced, the strength of the cover itself is increased, the deformation of the top surface of the cover after the mounting thereof is prevented, and the contact reliability of the contact between the resistor or electrodes and the arms of the slide contactors is enhanced.

Further, after each of the lead terminals is made to have an arbitrary length by suitably cutting wire material thereof to a required dimension, the lead terminals can be connected to the slide contactors. Therefore, it is possible to accommodate various demands for differing lengths of the lead terminal at a low cost. Especially, when a plurality of the variable resistors are wrapped into a taping set, the wire material can be used efficiently by suitably cutting the wire to the required length. As a result, the rate at which the material is used is efficient, and this reduces manufacturing cost.

Also, by insert-molding the case in a state where the lead terminals and the slide contactors are connected to each other, the connecting operation of the lead terminals and the slide contactors is performed before the case is resin-molded. Therefore, the resin-made case will not suffer from the influence of the heat generated at the time of resistance welding or ultrasonic welding, with the result that a product of good quality is obtained. Also, since the connection junction between the lead terminals and slide contactors is reinforced by the case, the bonding strength of the lead terminals as well as the sealability of the case is enhanced.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A variable resistor comprising:

a case having a recess portion;

at least two slide contactors exposed in a bottom surface of the recess portion of the case;

a rotor having a surface including a resistor and an electrode disposed thereon, said rotor being disposed in said recess portion of the case;

a cover disposed on an end opening of said recess portion of the case; and lead terminals having circular cross sections, said terminals being respectively electrically connected to said slide contactors;

said at least two slide contactors are respectively slidable on said resistor and said electrode;

wherein at least one of said slide contactors has an integrally formed extended portion which extends out from said case, and said lead terminals and slide contactors comprise separate parts; and wherein said lead terminals are directly attached to respective portions of said slide contactors, at least one of said lead terminals being directly contacted and bonded with said extended portion.

2. A variable resistor as set forth in claim 1, wherein said at least one of said slide contactors is insert-molded in said case.

3. A variable resistor as set forth in claim 1, wherein said at least one of said slide contactors includes a springy arm which projects outward from said bottom surface.

4. A variable resistor as set forth in claim 1, wherein said at least one of said slide contactors has an upper contactor layer and a lower contactor layer.

5. A variable resistor as set forth in claim 1, wherein said cover comprises at least one mounting claw portion for mating with a receiving hole in said case.

6. A variable resistor as set forth in claim 1, wherein said cover comprises a centrally disposed aperture having a ridge formed on the perimeter of said aperture.

7. A variable resistor as set forth in claim 1, further comprising a sealing O-ring mounted on said case.

8. A variable resistor as set forth in claim 1, wherein the rotor is made of insulating resin or ceramic.

9. A variable resistor as set forth in claim 1, wherein a longitudinal axis of said at least one of said lead terminals is disposed normal to a surface of said lead terminal connection section.

10. A variable resistor as set forth in claim 2, wherein said at least one of said terminals which is directly connected to said one slide contactor includes a flange at an end thereof.

11. A variable resistor as set forth in claim 2, wherein a bond between said one contactor and said one lead terminal is formed, and then the bonded contactor and terminal are integrally insert-molded into said case.

12. A variable resistor as set forth in claim 4, wherein said upper contactor layer and said lower contactor layer are formed by folding a single contactor layer to form two adjacent layers.

13. A variable resistor as set forth in claim 4, wherein said lower contactor layer prevents residue from contacting said upper contactor layer.

14. A variable resistor as set forth in claim 5, wherein said one mounting claw portion includes a slit formed therein.

15. A variable resistor according to claim 10, wherein said flange of said lead terminal is embedded in said case so as to secure said lead terminal to said one slide contactor.

16. A variable resistor according to claim 14, wherein a forward end portion is provided on said mounting claw portion which is folded back, and projections are provided on both sides of said mounting claw portion.

17. A variable resistor comprising:

a case having a recess portion;

at least two slide contactors exposed in a bottom surface of the recess portion of the case;

a rotor having a surface including a resistor and an electrode disposed thereon, said rotor being disposed in said recess portion of the case;

a cover disposed on an end opening of said recess portion of the case; and lead terminals having circular cross sections, said terminals being respectively electrically connected to said slide contactors;

said at least two slide contactors are respectively slidable on said resistor and said electrode;

wherein at least one of said slide contactors has an integrally formed connection section, and said lead terminals and slide contactors comprise separate parts; and wherein said lead terminals are directly attached to respective portions of said slide contactors, at least one of said lead terminals being directly contacted and bonded with said connection section.

18. A variable resistor comprising:

a case having a recess portion;

at least two slide contactors exposed in a bottom surface of the recess portion of the case;

a rotor having a surface including a resistor and an electrode disposed thereon, said rotor being disposed in said recess portion of the case;

a cover disposed on an end opening of said recess portion of the case; and lead terminals being respectively electrically connected to said slide contactors;

wherein said at least one of said slide contactors includes a springy arm which projects outward from said bottom surface;

wherein said lead terminals and slide contactors comprise separate parts, and said lead terminals are directly attached to respective portions of said slide contactors.

19. A variable resistor as set forth in claim 18, wherein said at least one of said slide contactors has an upper contactor layer and a lower contactor layer, and wherein said upper contactor layer and said lower contactor layer are formed by folding a single contactor layer to form two adjacent layers.

20. A variable resistor as set forth in claim 18, wherein a longitudinal axis of at least one of said lead terminals is disposed normal to a surface of its respective slide contactor portion.

21. A variable resistor as set forth in claim 18, wherein at least one of said lead terminals is directly bonded to a surface of its respective slide contactor portion.

22. A variable resistor comprising:

a case having a recess portion;

at least two slide contactors exposed in a bottom surface of the recess portion of the case;

a rotor having a surface including a resistor and an electrode disposed thereon, said rotor being disposed in said recess portion of the case;

lead terminals being respectively electrically connected to said slide contactors; and a cover disposed on an end opening of said recess portion of the case;

wherein said cover comprises at least one mounting claw portion mated with a receiving hole in said case;

wherein said mounting claw portion has a forward end portion and a rearward end portion, and said forward end portion is folded back to form an acute angle with respect to said rearward end portion, and wherein said rearward portion includes projections formed on its sides; and wherein said lead terminals and slide contactors comprise separate parts, and said lead terminals are directly attached to respective portions of said slide contactors.

23. A variable resistor as set forth in claim 22, wherein said one mounting claw includes a slit formed therein.

24. A variable resistor as set forth in claim 22, wherein said cover comprises a centrally disposed aperture having a ridge formed on the perimeter of said aperture.

* * * * *